US008113158B2

(12) United States Patent
Lancefield et al.

(10) Patent No.: US 8,113,158 B2
(45) Date of Patent: Feb. 14, 2012

(54) ENGINE WITH VARIABLE VALVE ACTUATING MECHANISM

(75) Inventors: Timothy Mark Lancefield, Shipston-on-Stour (GB); Ian Methley, Witney (GB)

(73) Assignee: Mechadyne PLC, Kirtlington (GB)

( * ) Notice: Subject to any disclaimer, the term of this patent is extended or adjusted under 35 U.S.C. 154(b) by 688 days.

(21) Appl. No.: 12/302,546

(22) PCT Filed: May 25, 2007

(86) PCT No.: PCT/GB2007/050299

§ 371 (c)(1),
(2), (4) Date: Nov. 26, 2008

(87) PCT Pub. No.: WO2007/138354

PCT Pub. Date: Dec. 6, 2007

(65) Prior Publication Data

US 2009/0178634 A1 Jul. 16, 2009

(30) Foreign Application Priority Data

May 31, 2006 (GB) ..... 0610633.0

(51) Int. Cl.
*F01L 1/34* (2006.01)

(52) U.S. Cl. ..... 123/90.17; 123/90.22

(58) Field of Classification Search ..... 123/90.15, 123/90.17, 90.22, 90.23
See application file for complete search history.

(56) References Cited

U.S. PATENT DOCUMENTS

| | | | | |
|---|---|---|---|---|
| 6,854,434 | B2 | 2/2005 | Methley | |
| 7,895,979 | B2 * | 3/2011 | Lancefield et al. | 123/90.15 |
| 2005/0087159 | A1 | 4/2005 | Harmon | |

FOREIGN PATENT DOCUMENTS

| | | |
|---|---|---|
| EP | 0440314 | 8/1991 |
| EP | 0909881 | 4/1999 |
| EP | 1614867 | 1/2006 |
| EP | 1669559 | 6/2006 |
| GB | 2180597 | 4/1987 |
| WO | 2004067922 | 8/2004 |

OTHER PUBLICATIONS

"Mechadyne Unveils Latest CAM Phaser Range," Automotive Engineer, Professional Engineering Publishing, London, GB, vol. 23, No. 1, Jan. 1998, p. 10, XP000730589.

* cited by examiner

*Primary Examiner* — Thomas Denion
*Assistant Examiner* — Daniel Bernstein
(74) *Attorney, Agent, or Firm* — Chernoff, Vilhauer, McClung & Stenzel

(57) ABSTRACT

An internal combustion engine is described having a valve mechanism that comprises an SCP camshaft operating two sets of valves. The first set of valves is operated via a summation rocker system such that the valve lift characteristic results from the combination of two cam profiles. The second set of valves has a valve lift characteristic that is different from that of the first set. In the invention, changing the valve lift characteristic of the first set of valves by varying the phase of the inner shaft of the SCP camshaft relative to the outer tube of the SCP camshaft serves additionally to alter the operation of the second set of valves.

10 Claims, 6 Drawing Sheets

Crankshaft Angle (degrees)

Crankshaft Angle (degrees)

ENGINE WITH VARIABLE VALVE ACTUATING MECHANISM

This is a national stage application filed under 35 USC 371 based on International Application No. PCT/GB2007/050299 filed May 25, 2007, and claims priority under 35 USC 119 of United Kingdom Patent Application No. 0610633.0 filed May 31, 2006.

FIELD OF THE INVENTION

The invention relates to an engine with a valve actuating mechanism that uses two cams acting via a summation mechanism to operate the valves.

BACKGROUND OF THE INVENTION

U.S. Pat. No. 6,941,910 shows how a summation lever can be used to combine the motion of two cam profiles in order to produce valve lift, and how the valve lift may be controlled by changing the relative phasing of the two cam profiles. The latter patent also teaches how phasing of the cam lobes relative to each other may be achieved by mounting them on the inner shaft and an outer tube of an assembled camshaft, termed an SCP (single cam phaser) camshaft, which has one set of lobes fixed for rotation with the outer tube and a second set fast in rotation with the inner shaft.

SUMMARY OF THE INVENTION

According to the present invention, there is provided an internal combustion engine having a valve mechanism that comprises an SCP camshaft operating two sets of valves, the first set of valves being operated via a summation rocker system such that the valve lift characteristic results from the combination of two cam profiles, the second set of valves having a valve lift characteristic that is different from that of the first set, wherein changing the valve lift characteristic of the first set of valves by varying the phase of the inner shaft of the SCP camshaft relative to the outer tube of the SCP camshaft serves additionally to alter the operation of the second set of valves.

The present invention is applicable to engines that use a single camshaft to actuate more than one set of valves e.g. intake and exhaust. The application of a cam lobe summation rocker system to one set of valves requires an SCP camshaft to be utilised in order to control the lift characteristic of this first set of valves. The invention takes advantages of the presence of an SCP camshaft to provide the opportunity to utilise any change in phase to bring about a change in the operation of a second set of valves.

The second set of valves may be actuated by a conventional rocker system, in which case changing the phasing of the SCP cam will bring about a simple phase change in the valve motion.

Alternatively, the second set of valves may be operated via a cam summation system, in which case the lift characteristics of both sets of valves may be changed concurrently.

Furthermore, a phaser with two outputs may be used at the front of the SCP camshaft in order to change its timing relative to the crankshaft, as well as the timing of the inner drive shaft relative to the outer camshaft tube. In this case, the two outputs of the phaser may either be independently controllable, or they may be linked such that they are phased in a fixed relationship to one another.

The invention has the following advantages when compared to existing designs: —

The motion characteristic of two sets of valves may be changed in different ways using a single control system.

Control of two sets of valves represents only a small cost increase compared to having only one set of valves with variable opening characteristic.

The system provides a compact design solution.

Having only one control parameter reduces engine calibration complexity.

BRIEF DESCRIPTION OF THE DRAWINGS

The invention will now be described further, by way of example, with reference to the accompanying drawings, in which.

DETAILED DESCRIPTION OF THE PREFERRED EMBODIMENT(S)

As both summation lever systems and SCP camshafts are well documented in the prior art, the ensuing description will assume that the reader is conversant with their principles of operation and the details of their construction.

Figure 1B:
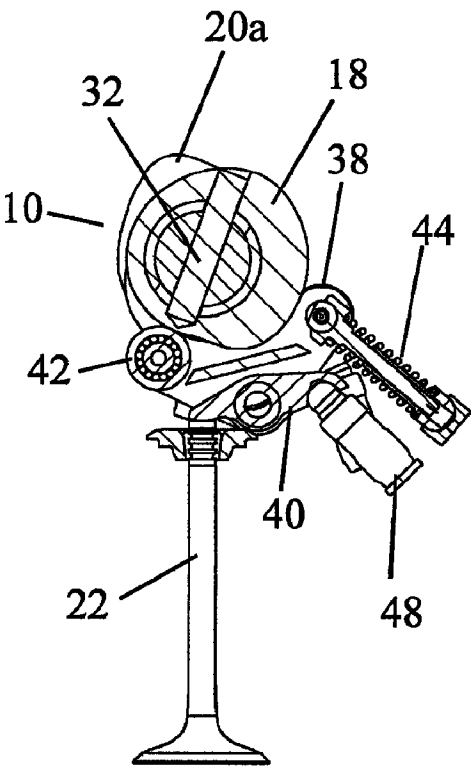
FIGS. 1A and 1B are sections in the planes A-A and B-B of FIG. 1, FIGS. 2 and 2A are isometric views of the valve train of FIG. 1.
Figure 1:
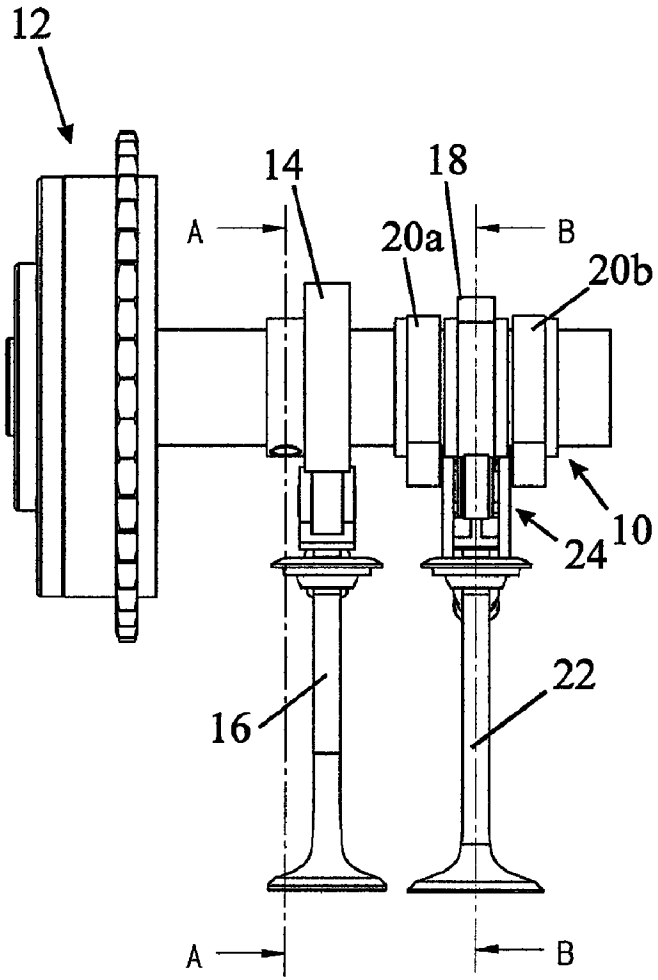
FIG. 1 shows a side view of valve train system with one cam summation system combined with a conventional rocker system driven by a common SCP camshaft and phaser.
Figure 1A:
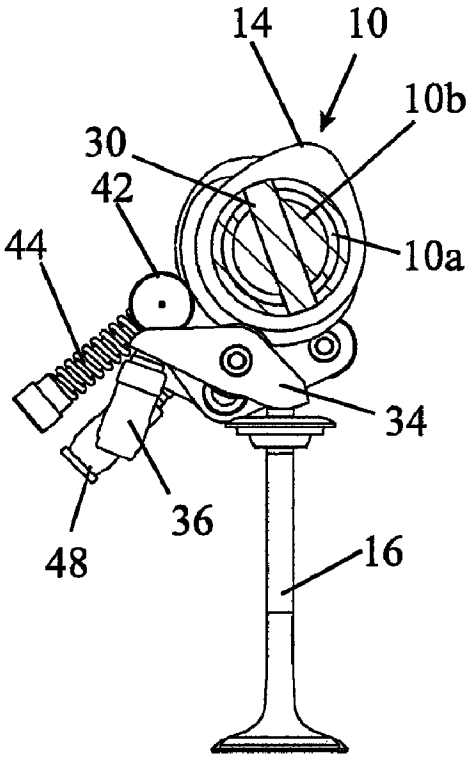

FIG. 1 shows an assembled SCP camshaft 10 which, as best shown in the section of FIG. 1A, is composed of an outer tube 10*a* and an inner shaft 10*b*. A phaser 12 mounted on the front end of the SCP camshaft 10 has two outputs, one driving the outer tube 10*a* and the other the inner shaft 10*b* of the SCP camshaft. The phaser may be constructed, for example, as a vane type phaser.

The camshaft carries four cam lobes, namely a first cam lobe 14 that operates a first valve 16, and three cams 18, 20*a* and 20*b* which together act on a second valve 22 by way of a summation lever system 24 which will be described in more detail below by reference to FIG. 2B. As can be seen from FIGS. 1A and 1B, the cams 14 and 18 are fixed for rotation with the inner shaft 10*b* of the camshaft by pins 30 and 32 that pass with circumferentially elongated slots in the outer tube 10*a* of the camshaft. The cam lobes 20*a* and 20*b*, on the other hand are identical with one another and both are fast in rotation with the outer tube 10*a* of the camshaft.

The cam lobe 14 acts on the valve 16 through a rocker 34 (see FIG. 1A) which contacts the stem of the valve 16 at one end, is supported on a lash adjuster 36 at the other end and has a central cam follower in contact with the cam lobe 14.

Figure 2B:
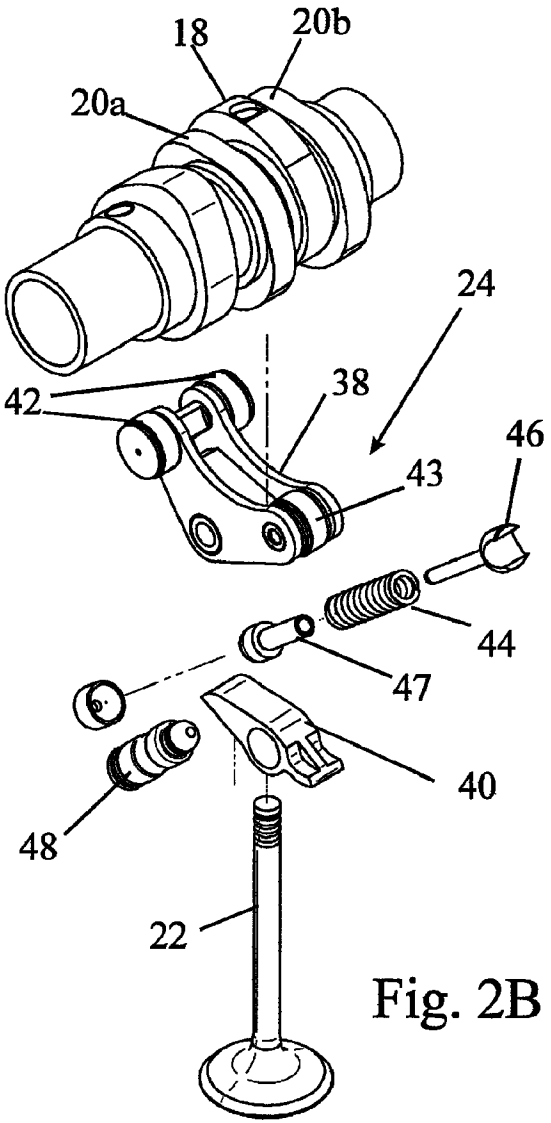
FIG. 2B is an exploded view of part of the valve train of FIG. 1, FIGS. 3, 4, 5, 6 and 8 show different valve timing regimes achievable by valve train system of the invention.

The cams 18, 20*a* and 20*b* act on the valve 22 through the lever system best shown in FIG. 2B which comprises a summation lever 38 and a rocker 40. A central region of the bell crank summation lever 38 is pivotably connected to the rocker 40. One end of the summation lever 38 carries a pair or cam follower rollers 42 which are rotatable about a common axis and are held in contact with the two cam lobes 20*a* and 20*b* by means of a spring 44 which acts on an axle of the rollers 42 by way of a cradle 46 carried by a telescopically collapsible guide pin 47 of the spring 44. The other end of the summation lever 38 carries a second roller follower 43 in contact with the cam lobe 18. The rocker 40 acts on the stem of the valve 22 at one end and its other end is supported by a lash adjuster 48.

Phasing the inner drive shaft 10*b* relative to the outer tube 10*a* will change the phasing of the valve 16 operated by the conventional rocker 34, and it will change the lift characteristic of the valve 22 produced by the summation system.

Figure 3:
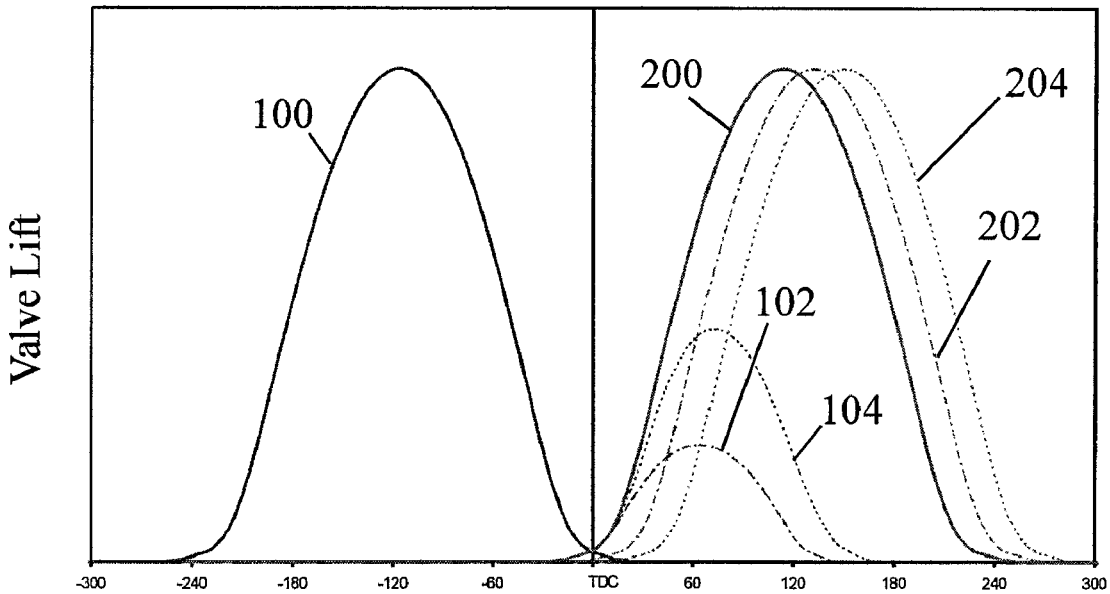
Figure 4:
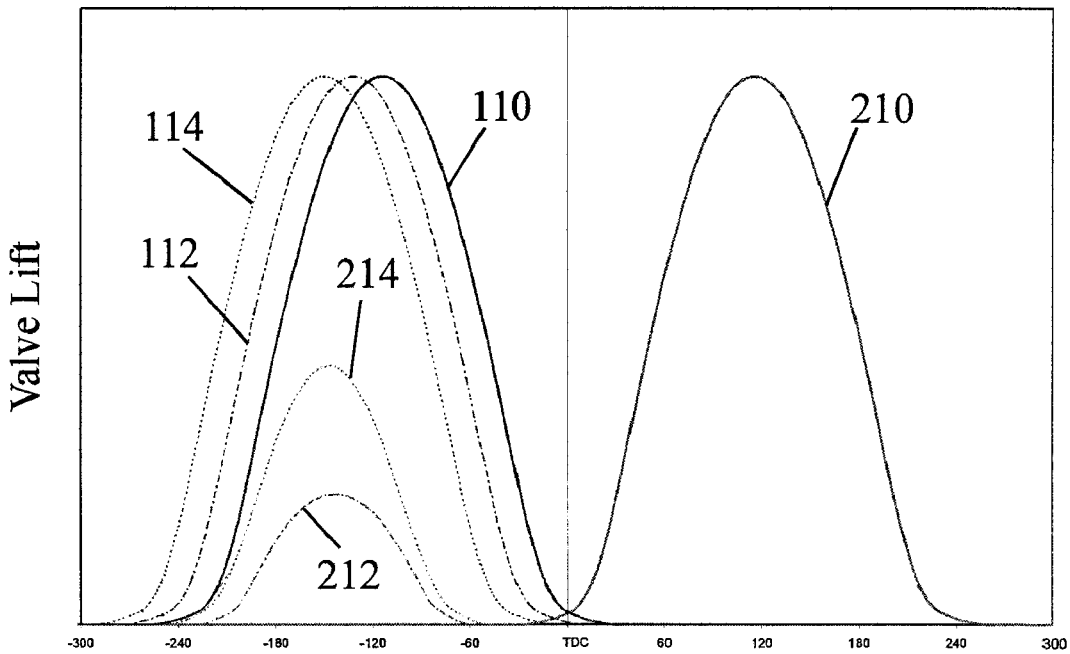

A variety of valve motion characteristics may be produced with a system of this kind, two examples being shown in FIGS. 3 and 4. In valve timing diagrams shown in all of the accompanying FIGS. 3 to 6 and 8, exhaust and intake and exhaust events that correspond with one another have been allocated the same reference numeral in the 100 and 200 series, respectively, and have been illustrated using lines that are matched in style (solid, dotted, chain dotted, etc).

In the example shown in FIG. 3, the cam summation rocker system is used to operate the exhaust valve in order to generate a controllable second exhaust lift event 102, 104 during the intake stroke 202, 204. The intake valve is operated by a conventional rocker system and the intake valve timing is varied relative to the crankshaft as the characteristic of the secondary exhaust lift is changed.

In FIG. 4, the cams with the summation system act on the intake valves in order to generate a controllable second lift 212, 214 in the exhaust stroke 112,114, whilst the exhaust valve has a conventional rocker system and is phased as the intake characteristic is adjusted.

It is important to note that in all embodiments of the invention, the range of SCP adjustment used to generate the second lift need only be a proportion of the full adjustment range of the SCP.

Furthermore, it would be possible to drive the SCP camshaft via a phasing system having two outputs, examples of which are described in EP 1234954 and EP 1030035. In the first of these patents, the phaser has two independently controllable outputs, and this would allow independent control of both the camshaft tube and the inner drive shaft relative to the engine crankshaft. In the second of these patents, the phaser has two outputs that move in a fixed relationship to one another, allowing the timing of both the camshaft tube and the inner drive shaft to be changed relative to the engine crankshaft in a fixed relationship. The advantage of the latter is that it only requires a single control input to control the timing of both the outer camshaft tube and the inner drive shaft of the SCP camshaft.

Figure 5:
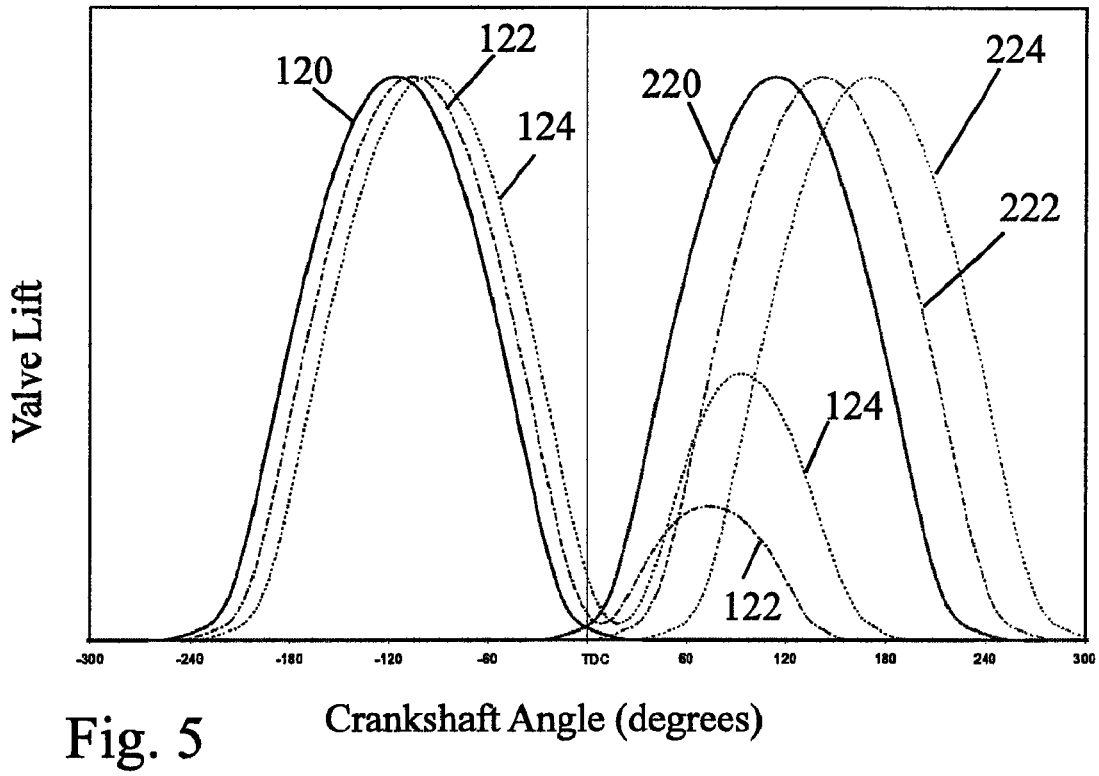
Figure 6:
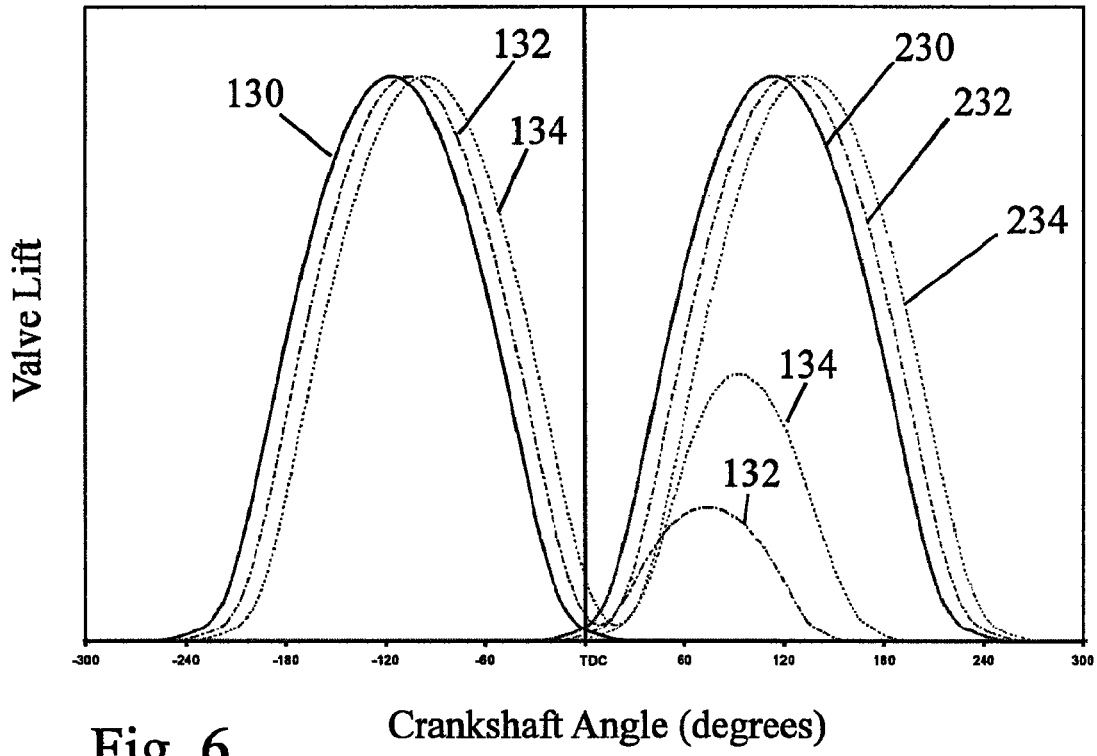

The use of a phaser with two outputs offers further flexibility to the valve train variations that may be achieved. Examples of these further options based upon the lift curves of FIG. 3 are shown in FIGS. 5 and 6. In FIG. 5, the summation rocker system is used to produce a secondary exhaust valve opening, and the phasing of the intake valve is linked to the inner shaft of the SCP camshaft and moves with the closing timing of the secondary exhaust valve lift.

In FIG. 6, the phasing of the intake valve is linked to the outer tube of the SCP camshaft and hence moves with the exhaust valve opening timing.

Figures 7, 7A, 7B, 7C, 7D:
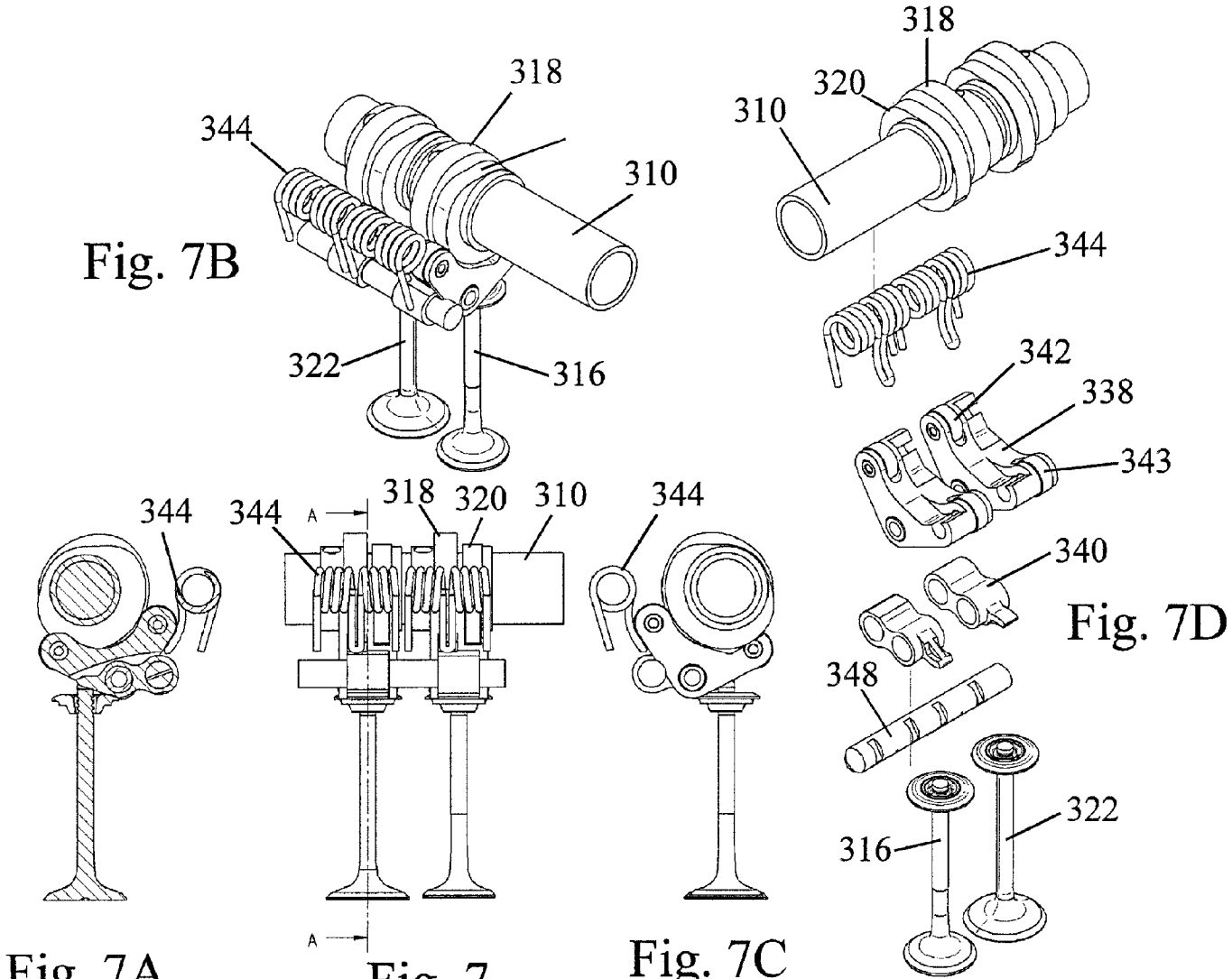
FIG. 7 is a side view of an alternative embodiment of the invention.
FIGS. 7A, 7B, 7C and 7D are respectively a section, an isometric view, an end view and an exploded view of a the embodiment shown in FIG. 7, and FIGS. 9 and 9A show isometric views of a still further embodiment of the invention.

A further design possibility would be to use a cam summation rocker system on both the intake and the exhaust valve, as shown in FIG. 7. This provides further possibilities for varying the motion of the two sets of valves.

Figure 2:
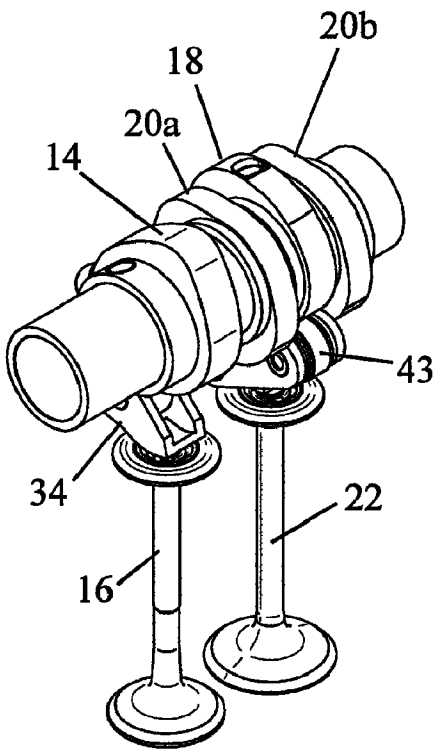
Figure 2A:
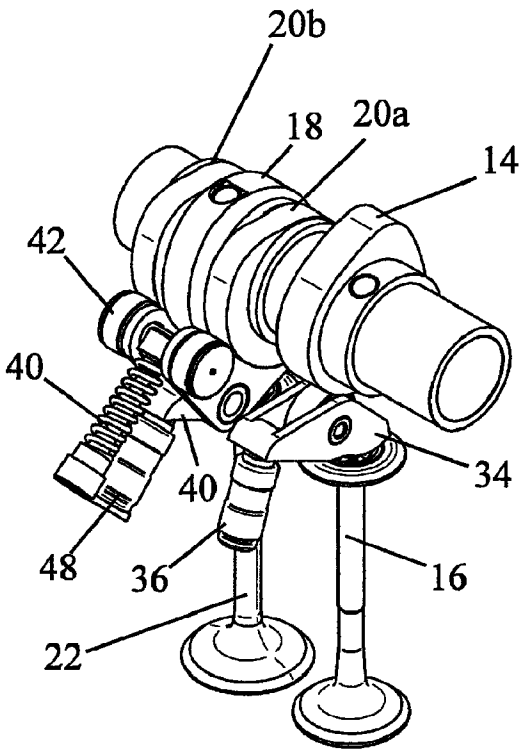

The summation rocker systems pictured in FIG. 7 are of a slightly different design from that shown of the embodiment of FIGS. 1 and 2. To avoid unnecessary repetition, components serving the same function as previously described have been allocated similar reference numerals but in the 300 series.

In this embodiment, the summation levers 338 have only two cam followers 342, 343 and a rocker shaft 348 is used to support the valve actuating rockers 340. This arrangement may be beneficial in some applications as it reduces the number of cam lobes required from six to four, and reduces the overall width of the rocker system for each valve. It may also be convenient to use a torque spring 344 to control the motion of the summation rocker as shown in FIG. 7D in place of the compression spring 44 shown in FIGS. 1 and 2.

Figure 8:
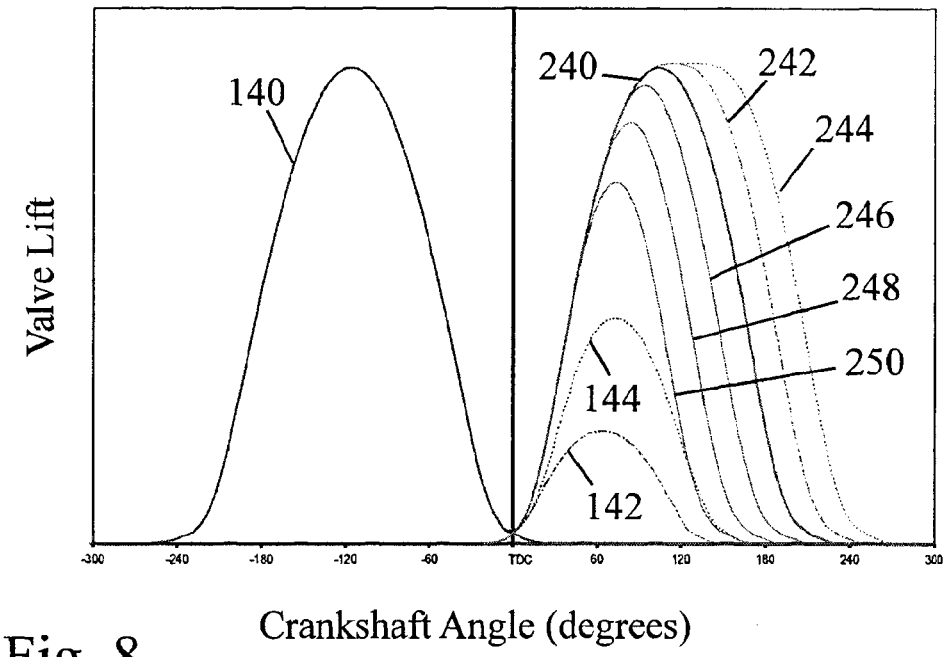

FIG. 8 shows the valve motion that could be achieved by using cam summation systems to achieve a controllable secondary exhaust lift and controllable opening duration on the intake valve. The additional exhaust lift only occurs at the two longest intake duration settings, and the exhaust valve has a single fixed event at the standard intake duration and at reduced intake duration settings. In this way, the exhaust valve lift is only varied over part of the SCP phasing range, whilst the intake is varied over the full range.

It would of course be possible to use a phaser with two outputs to control the timing of the whole SCP camshaft as well as controlling the relative timing of its two sets of cam lobes. This would allow the timing of the curves shown in FIG. 8 to be varied with respect to the crankshaft timing as required.

Figure 9:
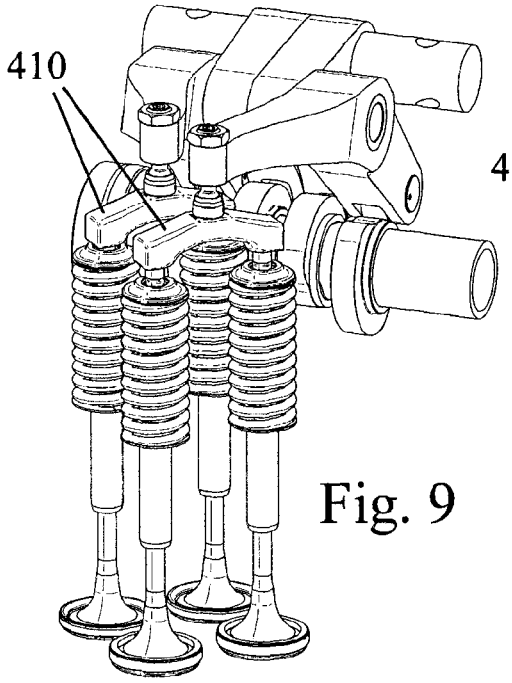
Figure 9A:
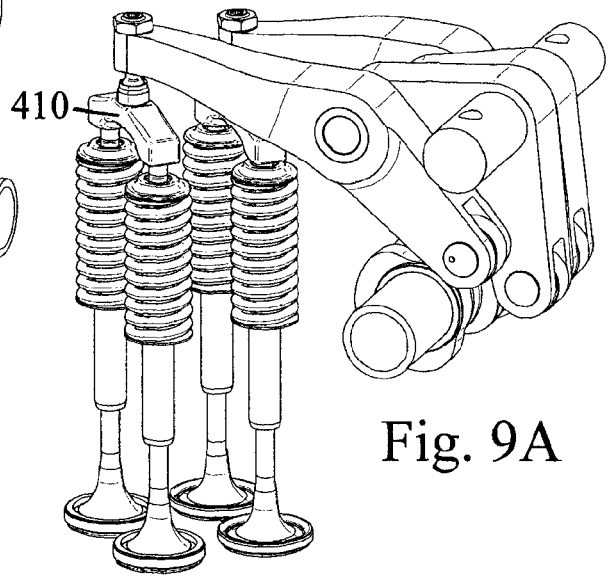

Whilst the previous figures have illustrated how this invention may be applied to a single camshaft engine with two valves per cylinder (one intake and one exhaust), it is possible for the system to operate in an engine with more than two valves per cylinder, as shown in FIG. 9.

FIG. 9 shows how two cam summation rocker systems of the design described in EP 1426569 and U.S. Pat. No. 6,854,434 may be operated by a single SCP camshaft, and bridge pieces 410 may be used to transmit the rocker motion to a pair of valves.

It would of course be possible to replace one of the summation rocker systems in FIG. 9 with a standard rocker system in order to produce the motion characteristics described in FIGS. 3 to 6.

The invention claimed is:

1. An internal combustion engine having a valve mechanism that comprises an SCP camshaft having an inner shaft and an outer tube and operating first and second sets of valves, the first set of valves being operated via a summation rocker system such that a valve lift characteristic of the first set of valves results from the combination of two cam profiles, the second set of valves having a valve lift characteristic that is different from that of the first set, wherein changing the valve lift characteristic of the first set of valves by varying a phase of the inner shaft of the SCP camshaft relative to the outer tube of the SCP camshaft serves additionally to alter the operation of the second set of valves.

2. An internal combustion engine as claimed in claim 1, wherein each of the valves of the second set is controlled by a single cam profile.

3. An internal combustion engine as claimed in claim 2, wherein changing the lift characteristic of the first set of valves is accompanied by a change in the timing of the second set of valves relative to a crankshaft.

4. An internal combustion engine as claimed in claim 3, wherein the timing of the second set of valves is synchronised with the opening timing of the first set of valves.

5. An internal combustion engine as claimed in claim 3, wherein the timing of the second set of valves is synchronised with the closing timing of the first set of valves.

6. An internal combustion engine as claimed in claim 1, wherein both sets of valves are operated via summation rocker systems, and the lift characteristic of the second set of valves change as the lift characteristic of the first set of valves is adjusted.

7. An internal combustion engine as claimed in claim 1, wherein a the summation rocker system is used to generate a secondary valve lift.

8. An internal combustion engine as claimed in claim 1, wherein the valves of the first set are exhaust valves and the valves of the second set are intake valves.

9. An internal combustion engine as claimed in claim 1, wherein valves of the first set are intake valves and valves of the second set are exhaust valves.

10. An internal combustion engine as claimed in claim 1, wherein bridge pieces are used to connect the summation rocker system to more than one valve.

* * * * *